United States Patent [19]

O'Brien

[11] Patent Number: 4,790,747

[45] Date of Patent: Dec. 13, 1988

[54] CONSUMABLE CANDLE WICK AND METHOD OF MAKING A CONSUMABLE CANDLE WICK

[75] Inventor: Mary O'Brien, Sherman Oaks, Calif.

[73] Assignee: Nuwick, Inc., Venice, Calif.

[21] Appl. No.: 678,259

[22] Filed: Dec. 5, 1984

Related U.S. Application Data

[63] Continuation of Ser. No. 435,747, Oct. 21, 1982, abandoned, which is a continuation-in-part of Ser. No. 307,450, Oct. 1, 1981, abandoned.

[51] Int. Cl.[4] ..... F23D 3/16

[52] U.S. Cl. ..... 431/325; 431/288; 431/120

[58] Field of Search ..... 431/120, 288, 325, 298, 431/291

[56] References Cited

U.S. PATENT DOCUMENTS

| | | | |
|---|---|---|---|
| 2,745,271 | 5/1956 | Walker | 431/288 |
| 3,385,649 | 5/1968 | Hicks | 431/291 |
| 3,560,122 | 2/1971 | Cassar | 431/288 |
| 3,652,197 | 3/1972 | Tokarz | 431/288 |
| 3,730,674 | 5/1973 | Gross | 431/288 |
| 4,507,077 | 3/1985 | Japper | 431/288 |

*Primary Examiner*—Samuel Scott
*Assistant Examiner*—H. A. Odar
*Attorney, Agent, or Firm*—Bright & Lorig

[57] ABSTRACT

The present invention is a new improved wick which is manufactured so as to allow the wick to burn for a longer period of time than existing wicking material. The wick is capable of being moved around the surface of a candle to maximize the life of the candle by burning all of the candle's wax instead of permitting the candle to burn only in the area immediately surrounding the wick as in the case with most conventional wicks. The wick comprises a single strand of tufted wire coil having a polyethylene and wax coating. One end of the coil is turned upward into a vertical section to compose the lighting element and the other end of the wire is wound into a circular base such that it touches the base of the vertical section.

17 Claims, 1 Drawing Sheet

CONSUMABLE CANDLE WICK AND METHOD OF MAKING A CONSUMABLE CANDLE WICK

This is a continuation of application Ser. No. 435,747, filed Oct. 21, 1982, which is a continuation-in-part of U.S. patent application Ser. No. 307,450, filed Oct. 1, 1981, both abandoned.

BACKGROUND OF THE INVENTION

1. Field of Invention

This invention relates to candles. More specifically, the invention relates to wicks which are placed on a candle to prolong the candle's life and efficiently utilize the candle's wax.

2. Prior Art

Candles and the manufacture of candles are well known in the art. To make an ordinary cylindrically shaped candle, a stationary wick is placed into the center of a candle mold. The stationary wick is a wax coated string made of cotton, nylon or other cloth material. The wick is attached to an overhead rod which is placed over the mold to hold the wick in the place as molten paraffin is poured into the mold and as the paraffin hardens. Once the candle paraffin has completely hardened, the wick is snipped from the rod and a finished candle is made.

Taper candles are made by a slightly different procedure. A wick is dipped a plurality of times into liquid paraffin. After each coat of paraffin dries, it is re-dipped until the desired thickness of the candle is obtained.

There are many problems caused by the wicks in these prior art candles. For example, when a flame on an ignited wick is smothered, the wick may drown itself in the candle wax that has melted around it while the wick was lit. The next time the candle is to be used, the molten candle wax will have hardened over the wick and in order to use the candle, the wick will have to be found and "dug out" of the hardened wax. Another problem that may arise after an ignited wick is smothered is that the wick may continue to burn down into the candle wax such that the end of the wick will be deep within the candle wax and not be able to be lit the next time the candle is to be used. A much more general problem inherent in most candles is that a wick will burn to the bottom or along one side of the candle such that approximately eighty percent (80%) of the candle wax has not melted. The remaining wax cannot be used since there is no longer a wick to burn it.

A new improved wick was invented in 1976 by the inventor of the present application which comprises a pipe cleaner coated with a wax containing no additives. The wick is shaped such that it has a circular base with a vertical section extending therefrom. The improved wick overcomes many of the problems inherent in the prior art, but it only burns up to for 15 hours not for the 25 or more hours required for emergency situations. Furthermore, the wick often gave off dark colored emissions and thus was aesthetically unpleasing.

Therefore, an improved wick which will prevent wick burnout, utilize over 100% of the candle wax and burn for over 25 hours would be a substantial advance in the art.

SUMMARY OF THE INVENTION

The present invention is a new improved wick which is manufactured so as to allow the wick to burn for a longer period of time than existing wicking material.

The wick is capable of being moved around the surface of a candle to maximize the life of the candle by burning all of the candle's wax instead of permitting the candle to burn only in the area immediately surrounding the wick as is the case with most conventional wicks.

The wick comprises a single strand of tufted coil having a polyethylene and wax coating. One end of the coil is turned upward into a vertical section to form the lighting element and the other end of the wire is wound into a circular base such that the end of the coil touches the base of the vertical section. The coil is shaped such that the length of the vertical section is equal to the diameter of the circular base.

The wick is wound by placing one end of the tufted coil into one end of a cylindrical tool which has an outer diameter approximating the diameter of the circular portion of the finished wick. The tool has a hole extending partially through one end thereof having a depth approximately equivalent to the height of the vertical section of the finished wick. After one end of the coil is placed into the hole, the other end of the coil extending from the hole is bent over into a notch on the side of the tool so that it is substantially flush therewith. The bend end is then wound around the outside of the tool to make the circular base. The second end of the coil is juxtaposed against the base of the vertical section.

The coiled wick is then removed from the tool and placed into a molten paraffin mixture. The paraffin mixture comprises a high temperature wax mixed with one teaspoon of polyethylene per pound of wax and if desired, a drop of dye. The wick is left in the paraffin mixture until all the air bubbles vanish. Then, the wick is taken out of the paraffin mixture and shaken to remove any excess wax. The finished wick is placed on a wire mesh board for drying.

These and other features of the invention will become apparent from the accompanying drawings in which like reference numerals refer to like parts and in which:

DETAILED DESCRIPTION OF THE INVENTION

Figure 1:
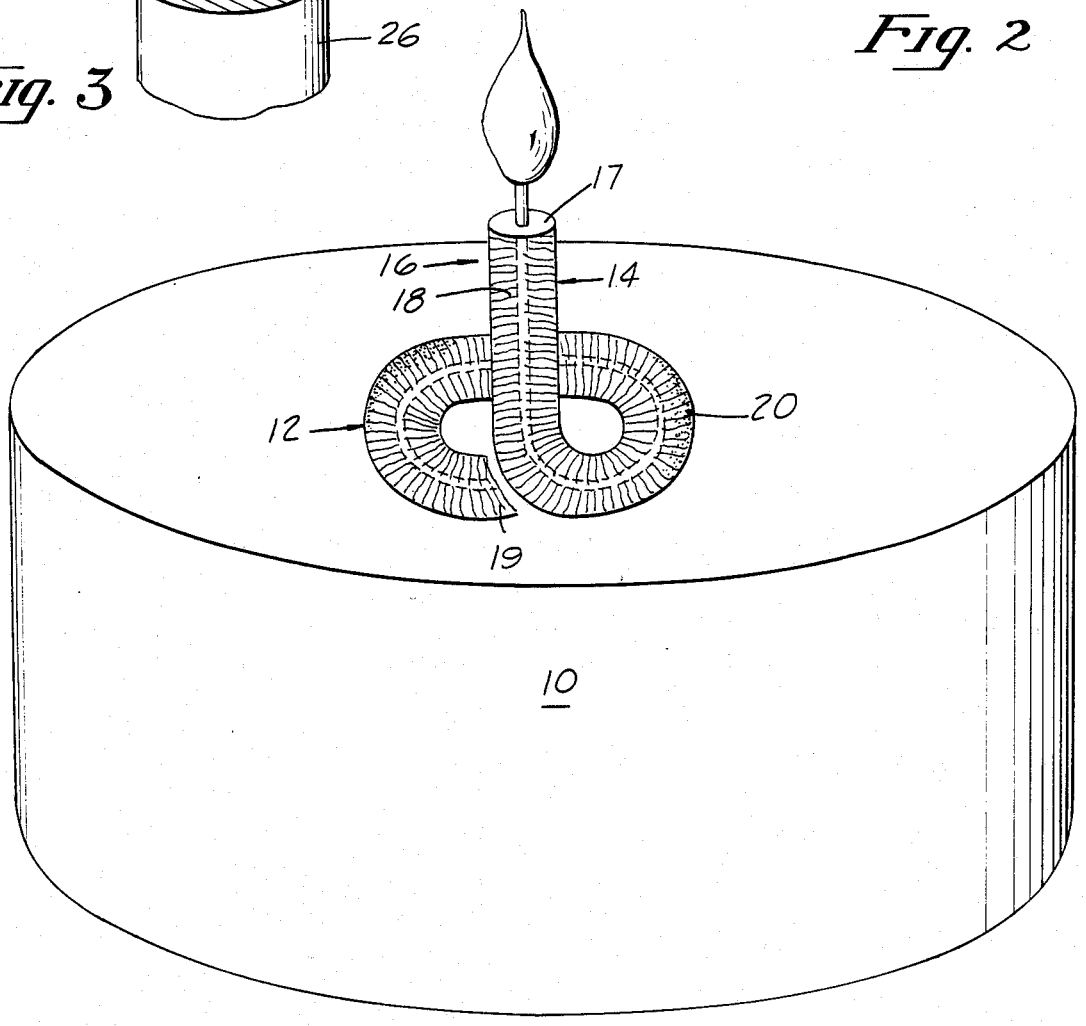
FIG. 1 is a perspective view of the wick of the present invention placed atop a candle and illustrating the center core of the wick.

In FIG. 1, the wick of the present invention has been placed atop a candle 10 and ignited. The wick is comprised of a core 16 of a semi-rigid material such as a dual strand wire coil to which tufting material 18 has been affixed by conventional methods. The tufting material 18 is preferably made of cotton although nylon and other similar materials may be used. In lieu of the wire coil affixed with cotton tufting, a standard commercially manufactured pipe cleaner may be used. The core is wound into a shape having a circular base portion 12 and a vertical section 14. The vertical section comprises the lighting element of the wick. The length of the vertical section is equal to the diameter of the circular base. It is believed that this shape hinders the flow of oxygen to the burning vertical section 14 and thus prolongs the burning time of the wick. In the preferred embodiment the circular base portion 12 is approximately 2 mm in diameter and the vertical section is approximately 2 mm high.

The core 16 is coated with a paraffin mixture comprising a high temperature wax 20 to which polyethylene has been added to improve the burning point of the wick. The coating is preferably 155° high temperature wax which is mixed with A-C-1 polyethylene in the proportions of one teaspoon of polyethylene to one pound of high temperature wax. For example, when the 155° high temperature wax is used, the burning point of the wax is increased from 155° to approximately 165° to 175° degrees. However, higher temperature wax may be used which will further increase the burning point of the wick.

Figure 3:
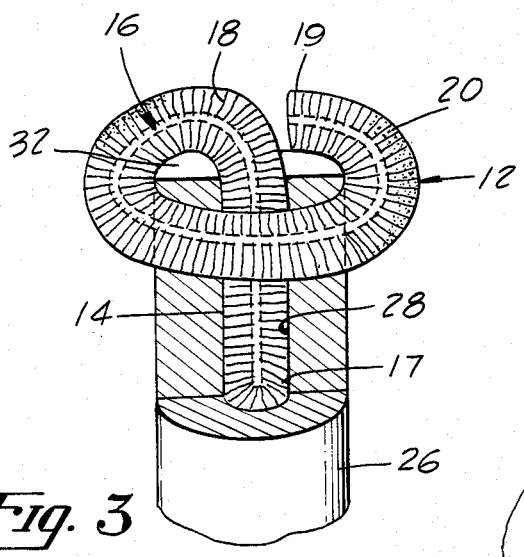
FIG. 3 is a cut away view of the tool used in forming the shape of the wick showing the core of the wick inserted therein and wrapped around, illustrating how the lower portion of the wick is wound into its circular shape.
Figure 2:
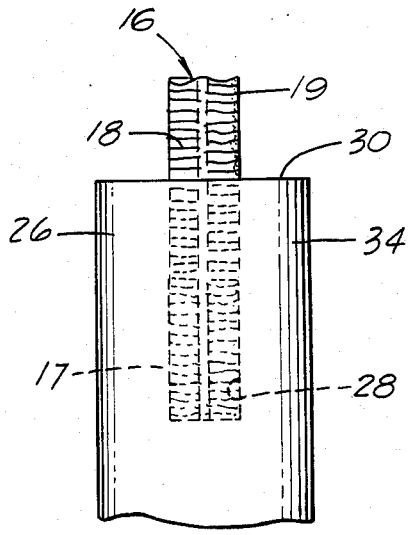
FIG. 2 is an elevational view of the core of the wick as it is placed in a tool for shaping.

Referring next to FIGS. 2 and 3, the wire coil 16 is affixed with cotton tufting to form the core 16. The core 16 is then cut into two inch lengths. A first end 17 of the core is placed into one end of a cylindrical tool 26 which has an outer diameter approximately the diameter of the circular portion of the finished wick. The tool also has a hole 28 extending partially through one end 30 thereof. In the preferred embodiment the diameter of the tool 26 and the depth of the hole 28 are each approximately 2 mm. The segment 19 of the core 16 extending from the tool is bent over into a notch on the side of the tool proximate end 30 and then is wound around the outer diameter 34 of the tool to form the circular base portion 12 of the wick.

The second end 19 of the wire coil 16 is placed so that it substantially touches the vertical portion 14. The coiled core 16 is then removed from the tool and set aside to be waxed.

The high temperature wax and the polyethylene are heated to a molten state. One teaspoon of the molten polyethylene is mixed into one pound of the molten wax. If desired, a drop of dye or scent may be added to the molten mixture. The shaped core is placed in the molten mixture for coating. The wick is left in the molten wax/polyethylene mixture until all of the air bubbles vanish (approximately 10 seconds) and then is taken out and shaken to remove any excess wax mixture. After the dipping process has been completed, the wax coated core is placed on a mesh board for drying.

To use on a candle, the wick is held by a tweezers and lit. The lit wick is then placed on a flat surface of the candle. The wick will burn for approximately twenty-five (25) hours on regular high temperature (approximately 155°) wax candle containing no additives before its vertical portion consumes itself. On a candle formed of a wax containing 129° wax, microwax (low burning wax) and steric acid the wick will burn for approximately forty (40) hours. As it burns upon the surface of the candle, it melts the candle wax surrounding its base forming a pool of melted wax. The wick sinks into the melted wax such that only the tip of the vertical section is exposed. The wick is constantly being fed by the melted wax which lengthens the amount of time it burns. Every three to four hours, the user of the wick may pick up the wick with a pair of tweezers as it burns and move it to an unburned and unmelted part of the surface of the candle in order to optimally burn all the wax of the candle. To extinguish the wick, the wick is overturned using a tweezers into the liquid wax and then placed on a dry wax base.

Thus has been described an new improved wick which burns a minimum of 25 hours and is more efficient than the presently existing wicks in the candles.

Obviously, while the invention has been disclosed and described with respect to a specific preferred embodiment thereof, it will be understood by those skilled in the art that various changes in form and detail may be made therein without departing from the spirit and scope of the invention.

What is claimed is:

1. A free-standing, consumable candle wick in combination with a meltable body of wax, comprising:

a tufted core having a first end and a second end, said first end being turned upward into a vertical section to form a lighting element, and the second end being wound into a circular base; and a wax mixture coating placed on said tufted core for improving the burning thereof;

said wick being placed on a flat surface of said meltable body of wax without being embedded in said meltable body of wax, such that when said wick is lit, said meltable body of wax is consumed.

2. The wick of claim 1, wherein said wax mixture coating has a melting point of approximately 155° F.

3. The wick of claim 2, wherein said wax mixture coating also includes polyethylene, and said wax mixture coating has a 3:1, pound to teaspoon, ratio of wax to polyethylene.

4. The wick of claim 2 wherein said wax mixture coating further comprises a consumable substance that increases the melting point of said wax mixture coating.

5. The wick of claim 1, wherein said wick is placed on a meltable body of a wax comprising paraffin having a melting point of approximately 129° F., microwax and steric acid, the wick will burn for approximately 40 hours.

6. The wick of claim 1 wherein said wax mixture coating further comprises a consumable substance that increases the melting point of said wax mixture coating.

7. A free-standing, consumable wick in combination with a meltable body of wax, comprising:

a semi-rigid core comprised of semi-rigid material and tufting material which is affixed thereto, said core having a first end and a second end, said first end being turned upward into a vertical section to form the lighting element, and the second end being wound into a circular base, wherein the length of the vertical section is substantially equal to the diameter of the circular base; and a wax mixture coating placed on said semi-rigid core;

said wick being placed on a flat surface of said meltable body of wax without being embedded in said meltable body of wax, such that when said wick is lit, said meltable body of wax is consumed.

8. The wick of claim 7, wherein said meltable body of wax has a melting point of approximately 155° F.

9. The wick of claim 8 wherein said wax mixture coating further comprises a consumable substance that increases the melting point of said wax mixture coating.

10. The wick of claim 7 wherein said wax mixture coating comprises a 3:1, pound-to-teaspoon, ratio of wax to polyethylene.

11. The candle wick of claim 7 wherein when said wick is placed on the meltable body of wax, said meltable body of wax including polyethylene having a melting point of approximately 129° F., the wick will burn for approximately 40 hours.

12. The wick of claim 7 wherein said wax mixture coating further comprises a consumable substance that increases the melting point of said wax mixture coating.

13. A method of making a free-standing consumable candle wick to be used in combination with a meltable body of wax comprising the steps of:

forming a semi-rigid core by affixing tufting material to a semi-rigid base, turning one end of the semi-rigid core upward into a vertical section, and winding the lower portion of the semi-rigid core into a circular base which touches the vertical section, placing the coiled core into a molten wax mixture to coat the core for improving the burning thereof, and removing the coated core from the wax mixture and drying the coated core, placing the finished wick on a flat surface of said meltable body of wax without embedding such in said body of wax, whereby the lighting of said wick causes the consumption of said body of wax.

14. The method of claim 13, further comprising the steps of:

after placing the core in said molten wax mixture, leaving the core in said wax mixture until all the air bubbles vanish.

15. The wick of claim 13 wherein said wax mixture coating further comprises a consumable substance that increases the melting point of said wax mixture coating.

16. The method of the claim 13, further comprising the steps of:

after forming the semi-rigid core, placing the core into one end of a cylindrical tool which has an outer diameter approximating the diameter of the circular portion of the finished wick, said tool having a hole extending partially through one end thereof having a depth approximately equivalent to the height of the vertical section of the finished wick, whereby after one end of the coil is placed into the hole, the other end of the core extending from the hole is bent over through a notch proximate the end of the tool so that it is substantially flush therewith and then is wound around the outside of the tool to make the circular base.

17. The wick of claim 13 wherein said wax mixture coating further comprises a consumable substance that increases the melting point of said wax mixture coating.

* * * * *